US011406868B2

(12) United States Patent
Sneathen

(10) Patent No.: US 11,406,868 B2
(45) Date of Patent: Aug. 9, 2022

(54) PUSH-UP EXERCISE DEVICE

(71) Applicant: Robert Wayne Sneathen, Mullica Hill, NJ (US)

(72) Inventor: Robert Wayne Sneathen, Mullica Hill, NJ (US)

( * ) Notice: Subject to any disclaimer, the term of this patent is extended or adjusted under 35 U.S.C. 154(b) by 334 days.

(21) Appl. No.: 16/825,957

(22) Filed: Mar. 20, 2020

(65) Prior Publication Data

US 2020/0298055 A1 Sep. 24, 2020

Related U.S. Application Data

(60) Provisional application No. 62/822,474, filed on Mar. 22, 2019.

(51) Int. Cl.

*A63B 23/12* (2006.01)
*A63B 21/00* (2006.01)
*A63B 21/068* (2006.01)

(52) U.S. Cl.

CPC .... *A63B 23/1236* (2013.01); *A63B 21/00047* (2013.01); *A63B 21/068* (2013.01); *A63B 21/4034* (2015.10); *A63B 21/4035* (2015.10); *A63B 2225/093* (2013.01)

(58) Field of Classification Search

CPC ..... A63B 21/00047; A63B 21/068; A63B 21/4034; A63B 21/4035; A63B 23/1236; A63B 71/023; A63B 2209/00; A63B 2209/02; A63B 2210/50; A63B 2225/09; A63B 2225/093

See application file for complete search history.

(56) References Cited

U.S. PATENT DOCUMENTS 4,923,194 A * 5/1990 Montgomery ... A63B 21/00047 482/141
5,466,206 A 11/1995 Fleming
6,129,651 A * 10/2000 Denaro ..... A63B 21/00047 482/141
7,377,888 B2 5/2008 Godbold
7,637,851 B1 * 12/2009 Lormil ..... A63B 21/4035 482/141
7,717,837 B2 * 5/2010 Florczak ..... A63B 1/00 482/62

(Continued)

OTHER PUBLICATIONS

Sunny Health & Fitness, Sunny Heath & Fitness Adjustable Push Up Bar, Amazon.com, Dec. 20, 2018, 5 pages.

*Primary Examiner* — Joshua Lee
(74) *Attorney, Agent, or Firm* — Condo Roccia Koptiw LLP

(57) ABSTRACT

A push-up exercise device enables the benefits of a body-weight exercise with a flexibility—and a level of granularity—in body angle typically reserved for machine-based exercises. Here, a push-up exercise device includes a base, a post that extends from the base, and a handle that is slidably attached to the post. The handle is configured to move continuously to locations along the vertical length of the post. And when in position, the handle can engage the post to hold the user's bodyweight. The ability to dial-in handle heights to very granular positions and the ability to set these heights independently of one another provides a significant level of variation in the muscles that are impacted when performing push-ups. This variation may provide for greater push-up effectiveness.

18 Claims, 11 Drawing Sheets

(56) References Cited

U.S. PATENT DOCUMENTS

| | | | | |
|---|---|---|---|---|
| 7,905,816 | B1 * | 3/2011 | Murphy | A63B 21/4019 482/114 |
| 8,343,021 | B1 | 1/2013 | Seraydarian et al. | |
| 9,248,334 | B2 * | 2/2016 | Dupuis | A63B 21/4035 |
| 9,517,382 | B2 | 12/2016 | Payne | |
| 9,526,942 | B2 | 12/2016 | Mills et al. | |
| 10,357,675 | B1 * | 7/2019 | Katz | A63B 21/00047 |
| 2005/0003938 | A1 * | 1/2005 | Henderson | A63B 21/4035 482/142 |
| 2012/0231937 | A1 * | 9/2012 | Murphy | A63B 21/4049 482/93 |
| 2013/0237394 | A1 * | 9/2013 | Fowler | A63B 21/00047 482/142 |
| 2014/0315700 | A1 * | 10/2014 | Stallman | A63B 23/1236 482/141 |
| 2016/0008656 | A1 * | 1/2016 | Critelli | A63B 23/1236 482/95 |

* cited by examiner

PUSH-UP EXERCISE DEVICE

This application claims the benefit of U.S. Provisional Patent Application No. 62/822,474, filed Mar. 22, 2019, the content of which is hereby incorporated by reference herein.

BACKGROUND

Bodyweight strength exercises are generally advantageous because of their minimal requirements. Because the user's body provides the weight against which the exercise is performed, bodyweight exercises do not require the substantially heavy weights and equipment required of other strength exercises, such as the bench press, for example.

The push-up is one such bodyweight exercise. The push-up is an example of a closed-chain horizontal press. It is considered, closed-chain because the distal end of the extremity, i.e., the user's hands, are fixed at the floor. Contrast this with the bench press, which is open-chain, i.e., the distal end of the arm is not fixed. Rather, it is holding a weighted bar in the air. Open-chain exercises tend to isolate a portion of the body doing the work. Closed-chain exercises, by contrast, tend to work the entire portion of the body performing the exercise. Because the position of the extremity is fixed, the portion of the body doing the work has to perform in a coordinated fashion, with each part doing its share. So from an athletic standpoint, closed-chain exercises, such as the push-up, can be more beneficial than open chain exercises. In this way, the bodyweight push-up has an advantage over the free-weight bench press.

One disadvantage of bodyweight exercises is the relative limited ability to adjust the angles and positions of extension and contraction. Properly designed benches and weight machines allow for a myriad of angles and body positions for various exercises. For example, when performing a set at the bench press, the user merely adjusts the angle of the bench to have a decline bench press, where the arms are closer to the body, or to have an incline bench press, where the arms are farther from the body. These differences in angles allow for different aspects of muscle groups to be worked and stressed and can be beneficial for exercise.

SUMMARY

The push-up exercise device, disclosed herein, enables the benefits of a bodyweight exercise with a flexibility—and a level of granularity—in body angle typically reserved for machine-based exercises. Here, a push-up exercise device includes a base, a post that extends from the base, and a handle that is slidably attached to the post. The handle is configured to move to locations along the vertical length of the post. And when in position, the handle can engage the post to hold the user's bodyweight.

With this push-up exercise device, the user may perform push-ups with their hands or feet at various heights from the floor. This change in position provides for changes in body angle. The device allows for a granularity in height selection, much better than merely doing a push-up off of a chair or bench—allowing a user to fine-tune their exercise experience and dial-in specific angles that promote a beneficial workout. And because the handles may be adjusted independently of one another, the user may perform push-ups with hands or feet at different heights to further introduce variety into the workout.

BRIEF DESCRIPTION OF THE DRAWINGS

FIG. 6A shows a top, cross-sectional view. FIG. 6B shows a lateral, cross-sectional view with the handle oriented to slide along the post. FIG. 6C shows a lateral, cross-sectional view with the handle oriented to engage the post.

DETAILED DESCRIPTION

Figure 1A:
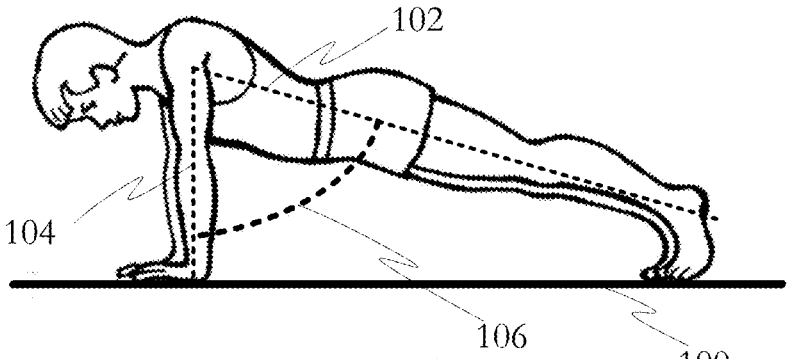
FIGS. 1A-B depict a typical floor push-up, in the extended position and contracted position respectively.
Figure 1B:
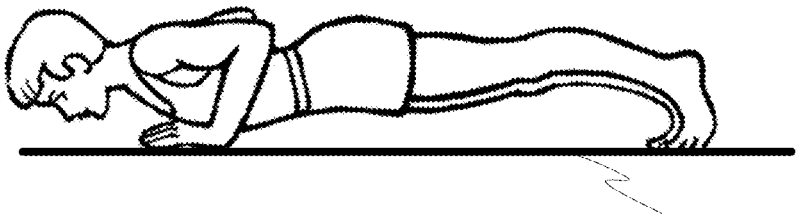

FIGS. 1A-B depict a typical floor push-up, in the extended position and contracted position respectively. Here, an exerciser is performing a bodyweight exercise known as a push-up off of a surface 100. The surface 100 is typically a floor. In the upright or extended position shown in FIG. 1A, the body of the of the exerciser defines two planes—a body plane 102 defined by the straight back and legs, and an arm plane 104 defined by the exerciser's straight arms.

The angle between the body plane 102 in the arm plane 104 is the push-up angle 106. The push-up angle 106 of a floor push-up is typically relatively close to 90°. It is dictated primarily by the length of the exerciser's torso and legs, the length of the exerciser's arms, and relative positioning of the exerciser's hands and feet.

Figure 2B:
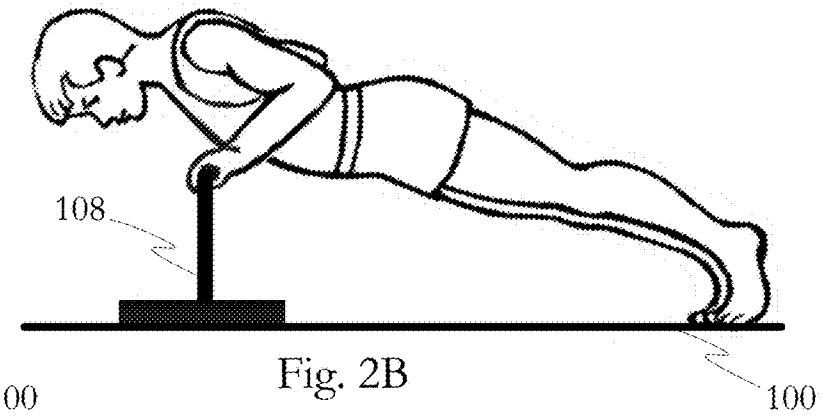
FIGS. 2A-B depict a push-up using a push-up exercise device, in the extended position and contracted position respectively.
Figure 2A:
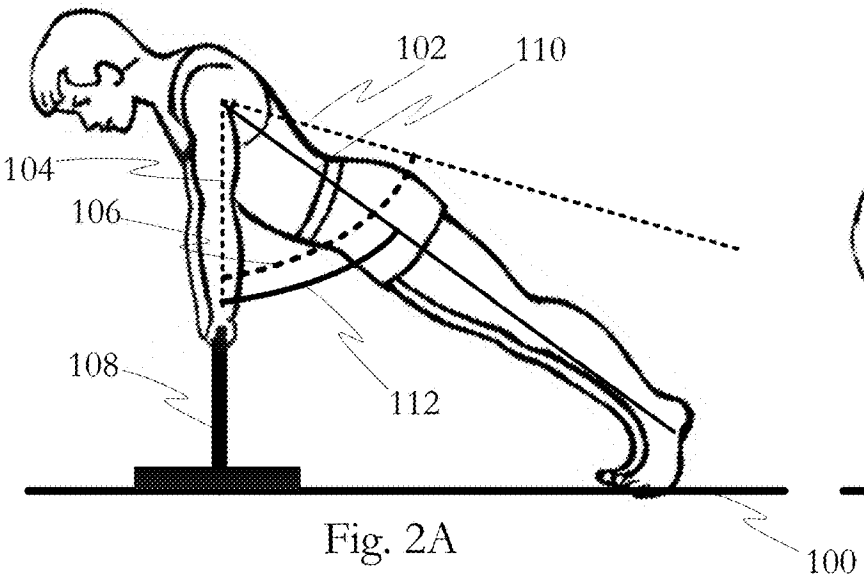

FIGS. 2A-B depict a push-up using a push-up exercise device, in the extended position and contracted position respectively. Here, the exerciser is using a push-up exercise device 108. Rather than having hands on the floor, the exerciser's hands grip the push-up exercise device 108 some distance from the floor. In effect, the push-up exercise device 108 increases the distance from hands to floor, lengthening the distance in the arm plane 104. This additional distance modifies body plane 110 and the corresponding push-up angle 112.

As a result, the exerciser may perform push-up exercises at angles different than that afforded by the floor push-up. The push-up exercise device 108 may enable different push-up angles 112 than the push-up angle 106 of a floor push-up. The push-up exercise device 108 may enable smaller push-up angles 112 than the push-up angle 110 of a floor push-up. The height of the push-up device 108 may be variable, so there may be a range of push-up angles 112 available to the exerciser.

Figure 3B:
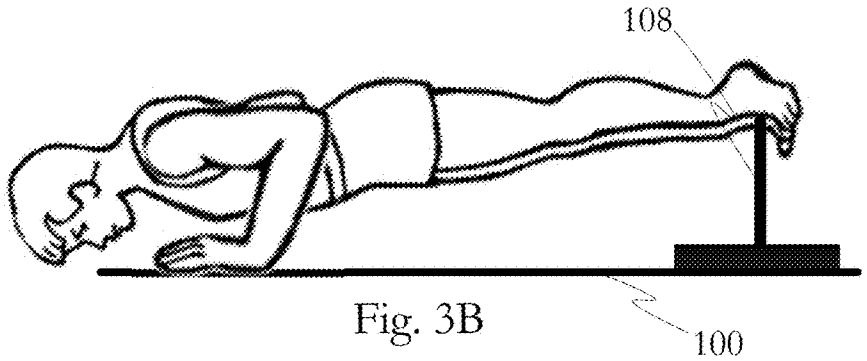
FIGS. 3A-B depict a push-up using a push-up exercise device, in the extended position and contracted position respectively.
Figure 3A:
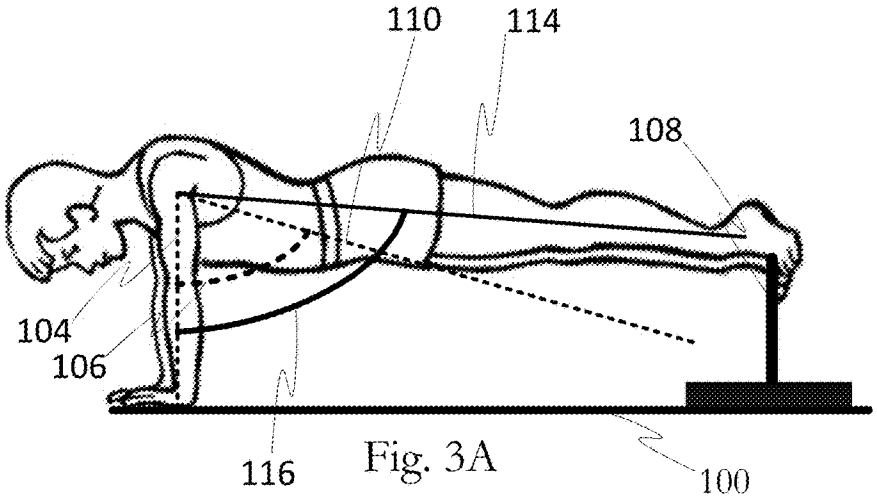

FIGS. 3A-B depict a push-up using a push-up exercise device, in the extended position and contracted position respectively. Here again, the exerciser is using a push-up exercise device 108. But rather than having feet on the floor, the top of the exerciser's feet rest across the push-up exercise device 108 some distance from the floor. In effect, the push-up exercise device 108 changes the relative positioning of the user's hands and feet, modifying the body plane 114 and the corresponding push-up angle 116.

As a result, the exerciser may perform push-up exercises at additional angles different than that afforded by the floor push-up and/or different than that available in the configuration shown in FIG. 2A-B. Here, the push-up exercise device 108 may enable larger push-up angles 116 than the push-up angle 106 of a floor push-up. The height of the push-up device 108 may be variable, so there may be a range of push-up angles 116 available to the exerciser. When set at a height larger than the length of the user's arms, the push-up angle 116 may exceed 90 degrees.

FIGS. 4A-H depict an example push-up exercise device 108 in perspective, exploded, front, left-side, right-side, top, bottom, and rear view, respectively. The push-up exercise device 108 may be made of any material of suitable strength and stiffness for bodyweight exercises. For example, the push-up exercise device 108 may be made of metal, such as a mild steel, hardened steel, aluminum, iron, or the like. The push-up exercise device 108 may be made composite materials such as carbon fiber, for example. The push-up exercise device 108 may be made from a combination of materials.

The push-up exercise device 108 may include a base 120, a post 122, and a handle 124. The base 120 may be shaped provide stability to the push-up exercise device 108 adequate for bodyweight push-ups. The base 120 may be configured to abut a surface, such as the floor, for example. The shape of the base 120 may be any shape suitable for providing adequate stability in the process of exercising. For example, the length and the width of the base 120 may be any length and width reasonable for providing stability for typical push-ups.

For example, the base 120 may include legs 125. For example, the base 120 may include four legs 125. Each leg 125 may extend radially from the center of the base 120. The legs 125 opposite each other may be formed from the same stock. And two sets of opposite legs 125 may interact at the center via a half-lap joint, in an example.

One or more of the legs 125 may each include a respective first portion 127. The first portion 127 may be fixed. For example, the first portion may be proximate to the center of the base 120. For example, the first portion may be proximate to the post 122.

One or more of the legs 125 may each include the respective first portion 127 and a respective second portion 129. The second portion 129 may be configured to widen the overall base 120. In an example, the second portion 129 may be fixed and/or static relative to the first portion 127. In an example, the second portion 129 may be moveable, e.g., extendable, from the first portion 127. For example, the second portion 129 may extend from the first portion 127 distally. The first portion 127 may be an open-ended, hollow structure into which the second portion 129 can slidably be inserted and extended. The first portion 127 and second portion 129 may be configured to effectively shorten or lengthen the length of the respective leg 125. This may effectively widen or narrow the overall width of the base 120.

The legs 125 may be configured, via the first portion 127 and the second portion 129, for example, to effectively widen or narrow the overall width of the base 120. Longer legs 125 may provide a wider base 120, which may provide greater stability to the user. Shorter legs 125 may provide a narrower base 120, which may provide less stability to the user. A user (e.g., a novice user) may desire greater stability to feel more secure when using the device 108. A user (e.g., an experienced user) may desire less stability to better engage core muscles when using the device 108. The width of the base 120 may be set in accordance with a level of stability appropriate to the height of the post 122. A user may desire to adjust a present length of the legs, via the first portion 127 and the second portion 129, for example, to achieve a level of stability commensurate with the height at which the handle 124 is set for a present exercise.

In an example, the first portion 127 and the second portion 129 may engage via a corresponding extension-engagement member 131. The extension-engagement member 131 may be configured to temporarily fix and unfix the relative positions of the first portion 127 and the second portion 129. For example, the extension-engagement member 131 may be configured to temporarily fix and unfix the first portion 127 and the second portion 129, such that the overall width of the base 120 is adjustable by the user. In an example, the extension-engagement member 131 may be configured to temporarily fix and unfix the first portion 127 and the second portion 129, such that the overall width of the base is adjustable by the user without tools. The extension-engagement member 131 may be any mechanical structure suitable for fixing the relative positions of the first portion 127 and the second portion 129. For example, the extension-engagement member 131 may include a static pin, a spring-loaded pop-pin, a screw with thumb-knob, and the like.

The post 122 may engage the base 120. The post 122 may engage the base 120 orthogonally. The post 122 may be manufactured to be unified with the base 120. The post 122 may be removeably fixed to the base 120. The base 120 may include a post-attachment member 133. The post-attachment member 133 may include any mechanical structure for removeably fixing the post 122 to the base 120. For example, the post-attachment member 133 may include a void into which the post 122 is inserted. The post-attachment member 133 may include one or more structures to securely fix the post 122 relative to the attachment member 133. For example, the post and the post-attachment member 133 may be fixed relative to each other by one or more of a static pin, a spring-loaded pop-pin, a screw with thumb-knob, and the like.

In an embodiment, the post 122 may include an integral screw plate (not shown) at an end that is inserted into a corresponding post-attachment member 133. Screws (not shown) may be inserted through the bottom of the legs 125, vertically, and threaded into the screw plate to join the post 122 and the base 120.

The post 122 may be any elongate member suitable for providing a vertical height to the push-up exercise device 108. The post 122 may be a beam of any suitable cross-section, such as a circular cross-section, rectangular cross-section, I-beam type, and the like. The post 122 may be constructed with a solid structure. The post 122 may be constructed with a hollow structure. The post 122 may be a hollow with a square cross-section, for example.

The post 122 may be any length suitable for incline push-ups. For example, the post 122 may be 60 inches in length. For example, the post 122 may be between 6 and 42 inches in length. For example, the post 122 may be between 12 and 36 inches in length. The post 122 may be about 28 inches in length.

The handle 124 may include a collar portion 126 and a grip portion 128. The collar portion 126 may be sized and shaped suitable to engage the post 122. The collar portion 126 may be sized and shaped to engage the post 122 in such a manner that in a first orientation relative to the post 122, the handle 124 may engage the post 122 to prevent the handle 124 from sliding freely and to support the weight of the user, and in a second orientation, the handle 124 may freely slide up and down the length of the post 122.

Figure 4A:
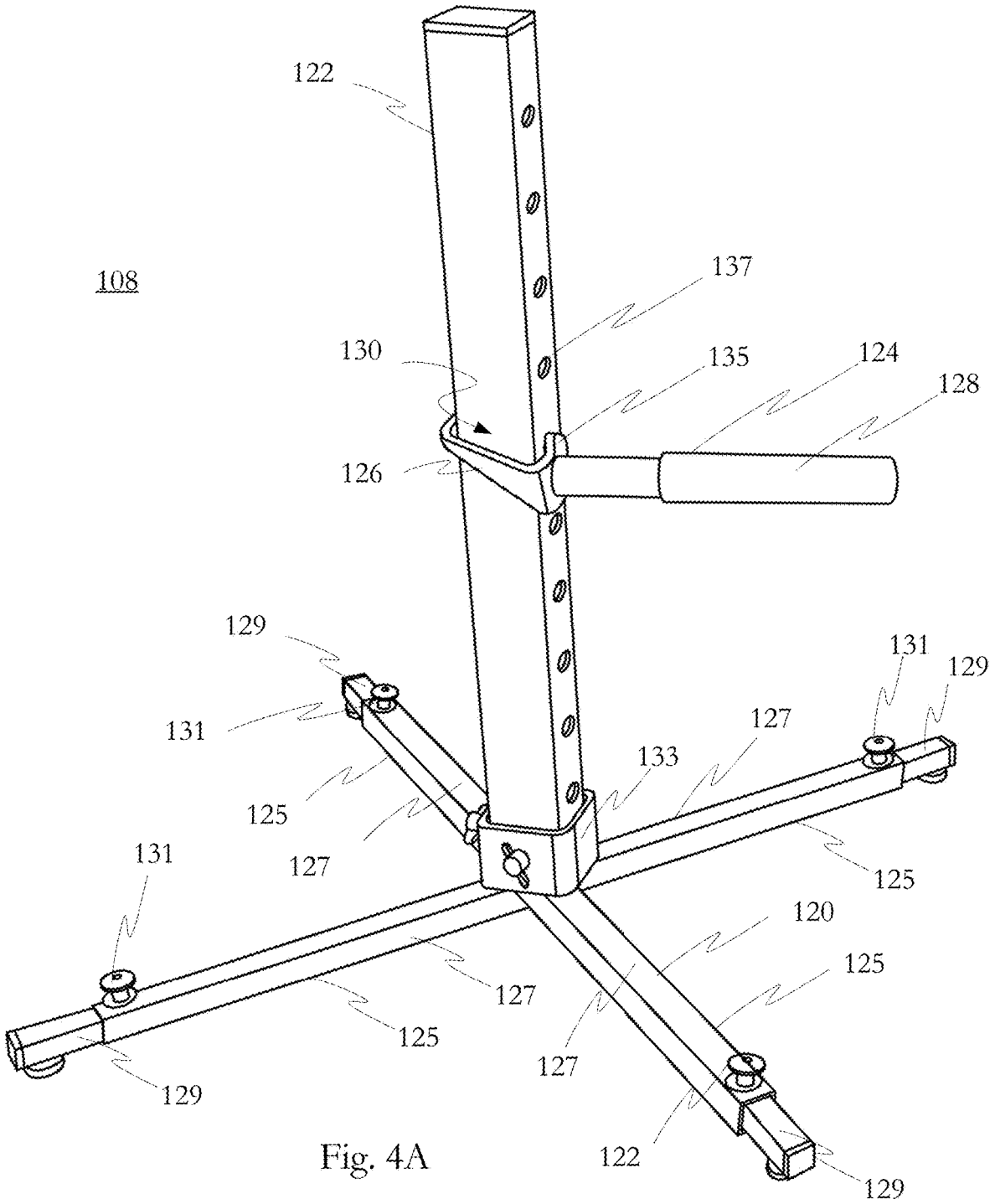
FIGS. 4A-H depict an example push-up exercise device in perspective, exploded, front, left-side, right-side, top, bottom, and rear view, respectively.
Figure 4B:
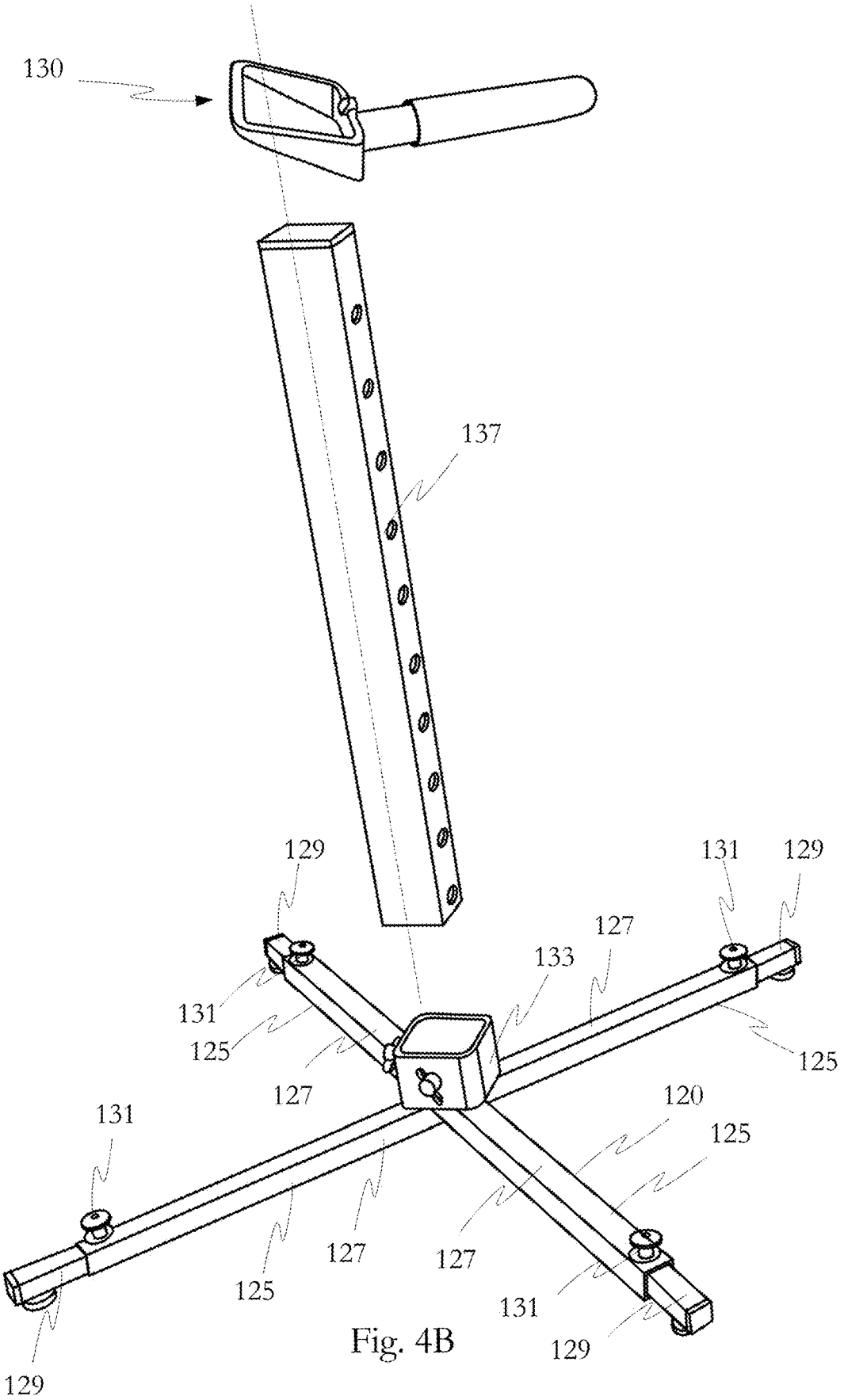
Figure 4F:
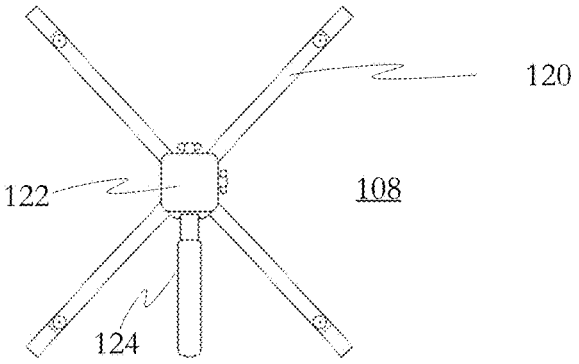
Figure 4D:
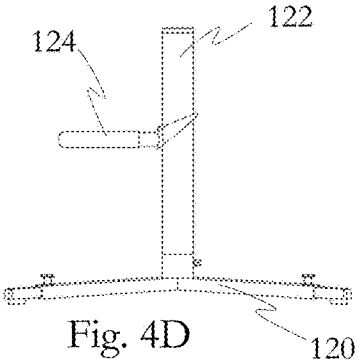
Figure 4C:
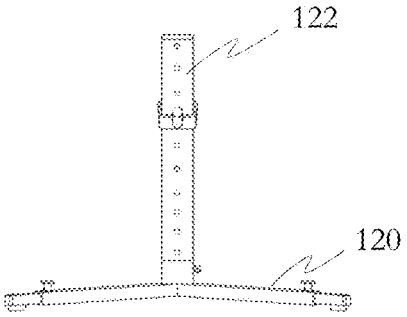
Figure 4E:
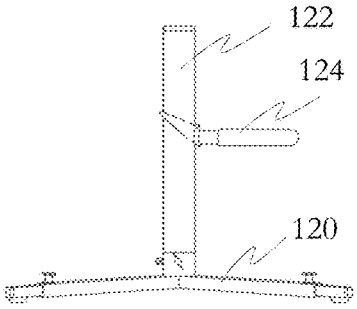
Figure 4G:
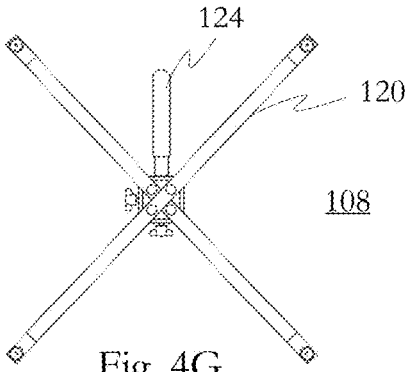
Figure 4H:
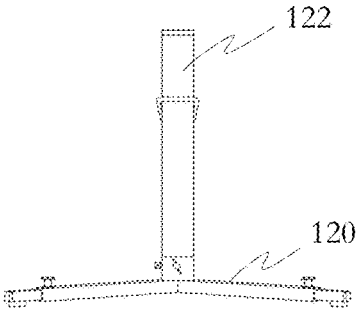
Figure 4I:
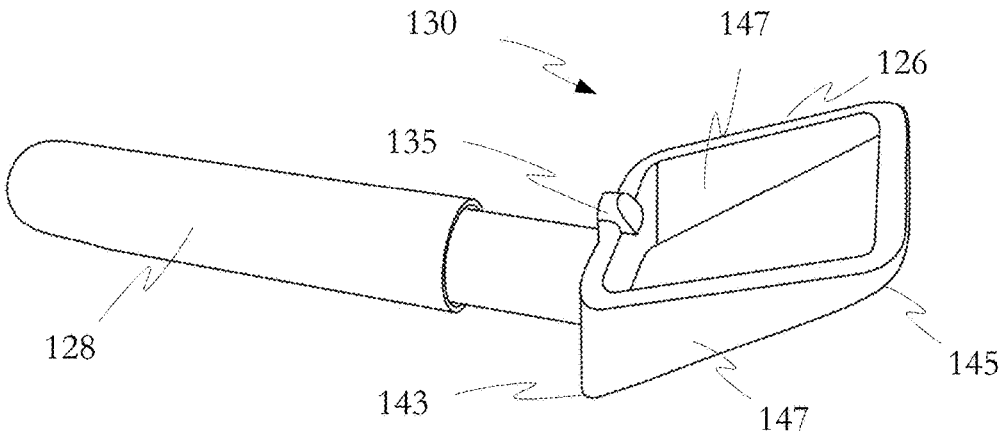
FIGS. 4I and 4J depict an example handle of the example push-up exercise device, with the handled shown isolated and engaged to a post, respectively.
Figure 4J:
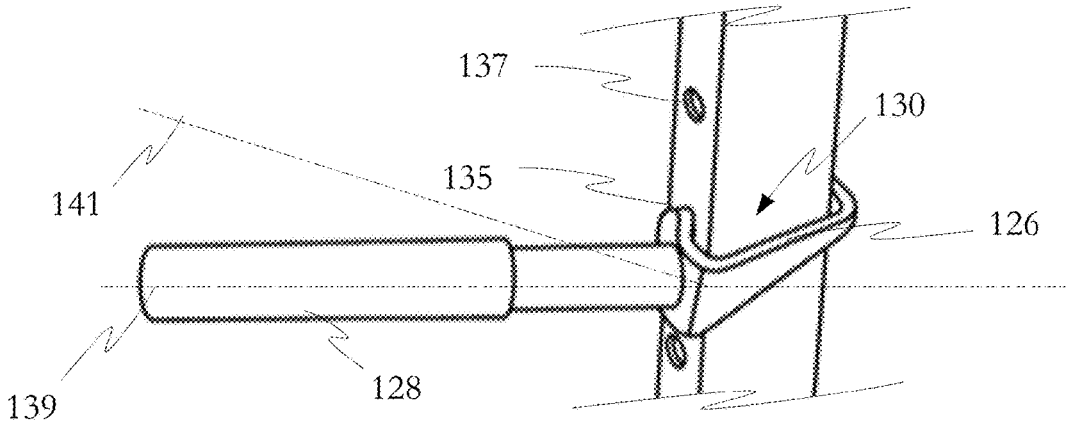

For example, FIGS. 4I and 4J depict the example handle 124 of the push-up exercise device 108, with the handle 124 shown isolated and engaged to the post 122, respectively. The handle may include a protrusion 135. And the post 122 may include a plurality of corresponding voids 137, into which the protrusion 135 may be removeably inserted. When the protrusion 135 is inserted into the void 137, the handle 124 may be engaged to the post 122 at that specific location on the post 122. That engagement may be sturdy enough to hold the body weight of the user doing push-up exercises.

For example, the handle may, in a first orientation 139, have the protrusion 135 inserted into the void 137, and in a second orientation 141, have the protrusion 135 removed from the void 137. The first orientation 139 may be effectively orthogonal to the post. And the second orientation 141 may be, as shown in FIG. 4J for example, tilted upwards relative to the post.

The collar portion 136 may be configured to accommodate the first and second orientations. In an example, the collar portion 126 may include a wide portion 143 and a narrow portion 145. The wide portion 143 may be disposed proximate to the grip portion 128. The narrow portion 145 may be disposed opposite the wide portion 143. The collar portion 126 may include one or more side portions 147. The side portion 147 may connect the wide portion 143 and the narrow portion 145. The side portion 147 may be tapered from the wide portion's width to the narrow portion's width.

The protrusion 135 may be disposed to have a clear eye-line to a user performing a push-up with the user's hand is on the grip portion 128 of the handle 124. The protrusion 135 may be disposed at an upper portion of the collar portion 136. The protrusion 135 may be positioned to facilitate the user's action of inserting the protrusion 135 into the void 137 when in a push-up position. For example, by having a clear line-of-sight to the protrusion, the user can accurately move the handle 124 to the position in which the protrusion can be inserted. For example, having the protrusion at an upper portion of the collar portion 136 facilitates a clear line-of-sight between the protrusion 135 and a user in the push-up position.

The protrusion 135 may be positioned to facilitate the user's action of inserting the protrusion 135 into the void 137 when in a push-up position. For example, the protrusion 135 may be disposed at an upper portion of the collar portion 136. Having the protrusion at an upper portion of the collar portion 136 may help the downward force applied by the user to guide the protrusion 135 into the void 137. For example, when a user engages the protrusion 135 against the post 122 at an area above a particular void 137, the downward force and relative geometry of the collar portion 136 and the protrusion 135 may keep the protrusion 135 pressed against the post 122 as the handle 124 slides down the post 122 until the protrusion 135 effectively "falls into" the void 137. This aspect may facilitate the safe operation of the device 108.

In an embodiment, the collar portion 136 may provide frictional engagement to be secured to the post 122 without a protrusion 135, for example. When pressed down in in the first orientation 139, the wide portion's lower edge and the narrow portions upper edge may frictionally engage the post 122, such that the handle is held in position. For example, a material with a high coefficient of static friction may be used to at the collar portion 136 and/or the post 122.

The handle 124 may be sized and shaped to provide support to a user's hands and/or feet. The handle 124 may be made of any material suitable for supporting the weight of the user and resisting the torque of the that weight against the post 122. The grip portion 128 may include a material for providing a comfortable grip. For example, the grip portion 128 may be covered with a foam, fabric, or other soft, resilient material. Because the push-up device 108 may be used to support a user's feet, the handle 124 may be covered with a material to improve friction with the upper surface of a user's athletic shoes. In an example, the handle 124 may be a replaceable component with a first handle specifically for griping by hand and a second handle specifically for supporting feet.

Figure 5:
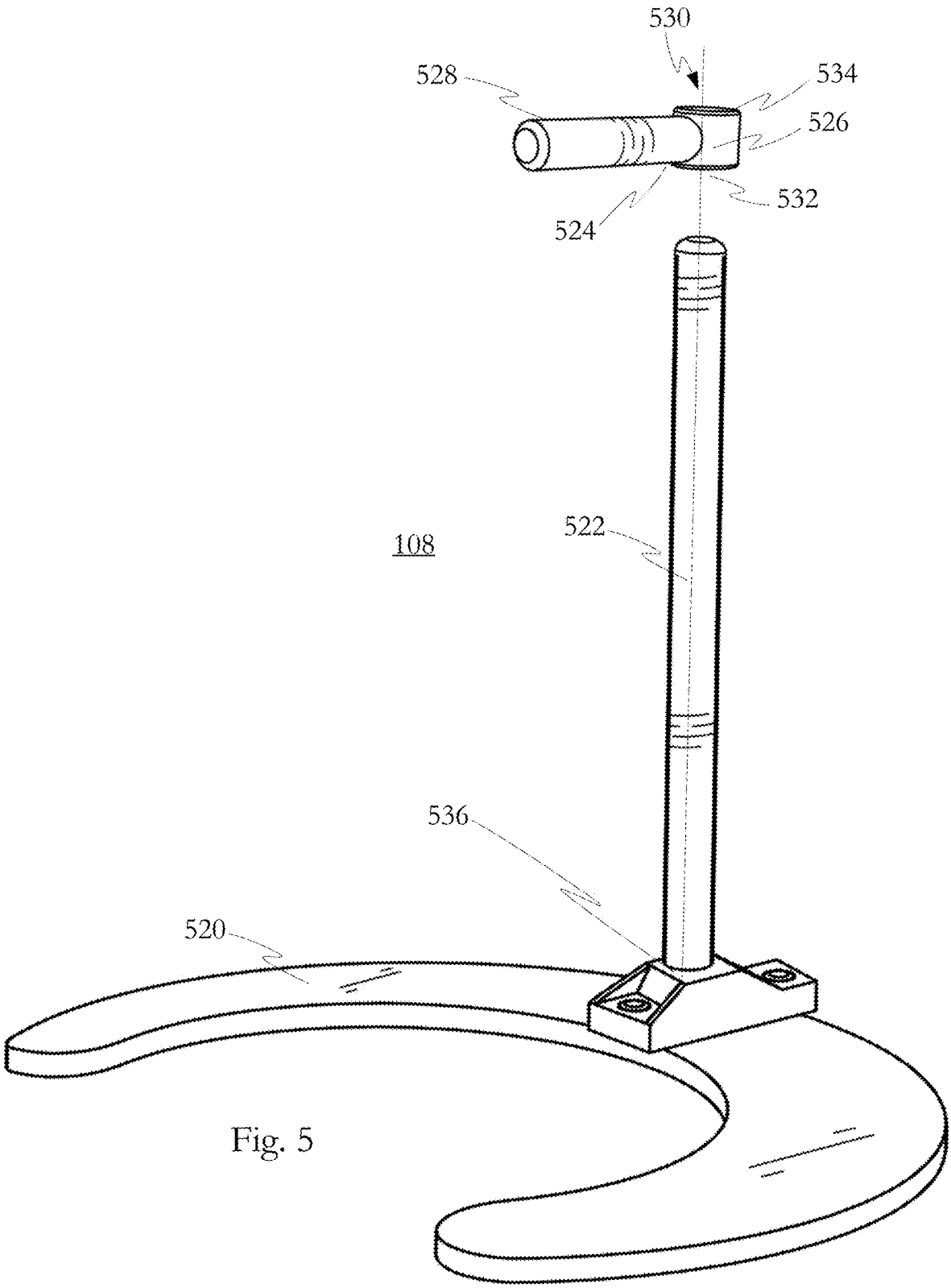
FIG. 5 depicts an example push-up exercise device, exploded, in perspective view.

FIG. 5 depicts an example push-up exercise device, exploded, in perspective view. The push-up exercise device 508 may include a base 520, a post 522, and a handle 524. The base 520 may be a flat portion of material. The base 520 may be crescent-shaped, for example.

The post 522 may engage the base 520. The post 522 may engage the base 520 orthogonally. The post 522 may be a pole. The post 522 may be a beam of any suitable cross-section, such as a circular cross-section, rectangular cross-section, I-beam type, and the like. The post 522 may be constructed with a solid structure. The post 522 may be constructed with a hollow structure.

The handle 524 may include a collar portion 526 and a grip portion 528. The collar portion 526 may be sized and shaped suitable to engage the post 522. The collar portion 526 may be sized and shaped to engage the post 522 in such a manner that the handle 524 may freely slide up and down the length of the post 522, but when pressure is applied to the grip portion 528, the collar portion 526 tilts out of axis with the post 522 and friction between the collar portion 526 and the post 522 prevent the handle 524 from sliding freely.

The collar portion 526 may have an opening 530 to enclose the post 522. The collar portion 526 may include a bottom edge 532 and a top edge 534. The opening 530 may be sized to slide freely over the post 522 when the opening 530 is axially aligned with the post 522. And the opening 530 may engage the post 522 at the top edge 534 and the bottom edge 532 when slightly tilted. So in use, the handle 524 may be oriented by the user to align the opening 530 and the post 522 so the handle 524 may slide freely and continuously to any vertical position on the post 522. And then when no longer so aligned, the weight and corresponding torque of the handle 524 will slightly tilt the collar portion 526 to engage the top edge 534 and the bottom edge 532 with the post 522. The friction of this engagement will hold the handle 524 in place at that specific location on the post 522. That engagement may be sturdy enough to hold the body weight of the user doing push-up exercises.

The handle 524 may be sized and shaped to provide support to a user's hands and/or feet. The handle 524 may be made of any material suitable for supporting the weight of the user and resisting the torque of the that weight against the post 522.

The post 522 and the base 520 may be removably attached to one another. For example, the base 520 may include a fastener 536. The fastener 536 may facilitate the connection of the post 522 to the base 520. For example, the fastener 536 may be fixedly attached to the post 522 and may be removably attached to the base 520 via nuts and bolts for example. In another example, the fastener 536 may be integral to the base 520 and include a threaded aperture to receive a correspondingly threaded portion of the post 522. When the base 520 and the handle 524 are separated from the post 522, the individual components may be stored flat for ease of shipping and storage.

Figure 6A:
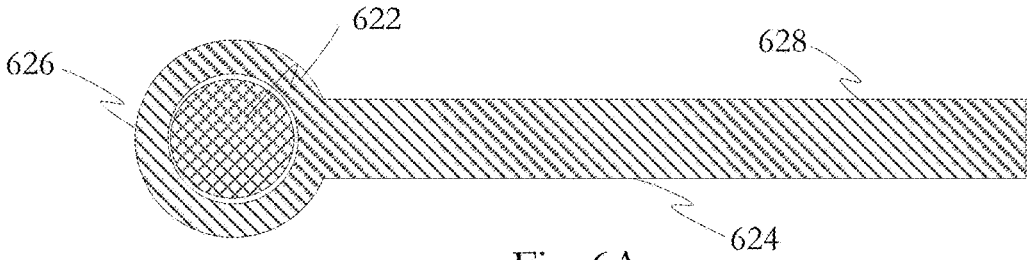
FIGS. 6A-C depict a handle and post of an example push-up exercise device, with a cylindrical post.
Figure 6B:
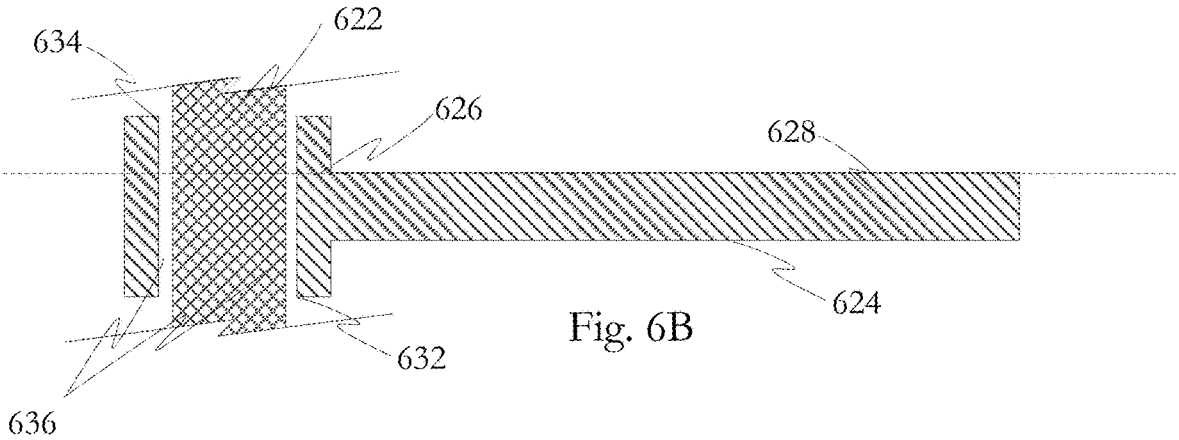
Figure 6C:
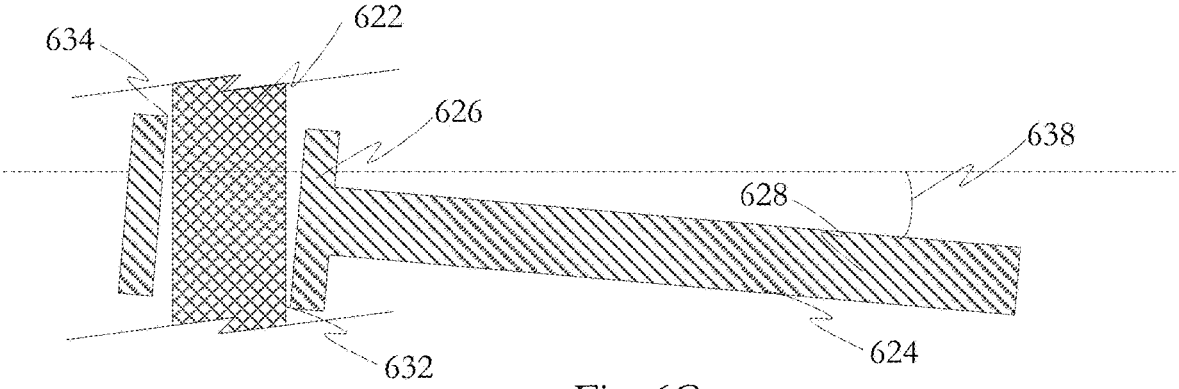

FIGS. 6A-C depict a handle 624 and post 622 of an example push-up exercise device, with a cylindrical post 622. FIG. 6A shows a top, cross-sectional view. Here, the handle 624 has an elongate grip portion 628 and a cylindrical collar portion 626. The post 622 and the collar portion 626 may be relatively sized such that the inner diameter of the collar portion 626 is slightly larger than the outer diameter of the post 622. In a typical implementation, there may be a 1-4 millimeter difference in diameter. In some implementation this tolerance may be less or greater in accordance with manufacturing practices. The specific allowance for this tolerance may be dictated by the parts' ability to slide freely when aligned and engage when slightly tilted.

FIG. 6B shows a lateral, cross-sectional view with the handle 624 oriented to slide freely along the post 622. Note that the larger diameter of the collar portion 626 allows for a void 636 between the collar portion 626 and the post 622 when collar portion 626 and the post 622 are axially aligned. In an example, the grip portion 628 of the handle 624 may be disposed to be perpendicular to the post 622 when the collar portion 626 and the post 622 are axially aligned. Accordingly, in use, the user may orient the handle 624 to the perpendicular and slide the handle 624 freely and continuously to any position along the post 622 desired for performing a push-up. And when the handle 624 is in the desired position, the user may engage the handle 624 to the post 622 to secure it and ready it to receive the user's body weight when performing the push-up.

FIG. 6C shows a lateral, cross-sectional view with the handle 624 oriented to engage the post. Here, we illustrate when a downward force is placed on the handle 624—either by the user and/or by the weight of the grip portion 628 itself—the handle 624 tilts slightly as allowed by the tolerance of the void 636. Accordingly, a top edge 634 and a bottom edge 632 of the collar portion 626 engage the post 622. The engagement may provide adequate friction to support the body weight of the user for performance of a push-up. In an example, the grip portion may tilt at a downward angle 638 relative to the post. A downward angle of 1-2 degrees, for example, may be adequate for engagement while still being relatively horizontal enough to be suitable for the user to perform a push-up.

Figure 7:
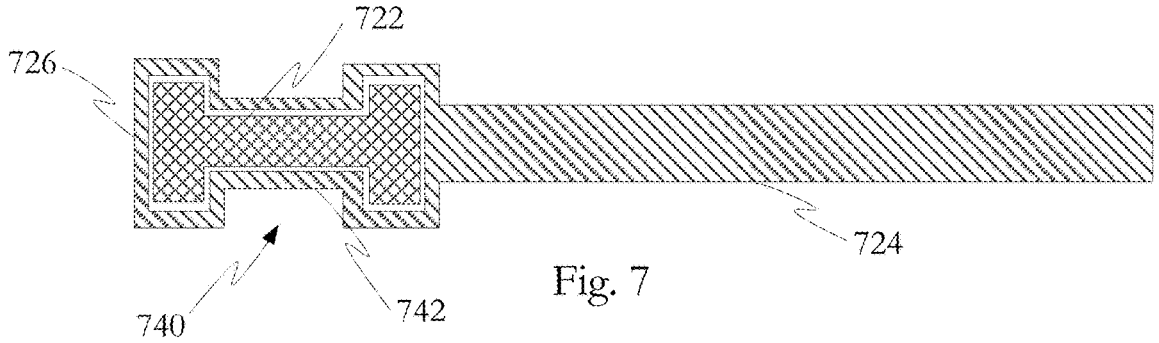
FIG. 7 depicts a handle and post of an example push-up exercise device, with an I-beam post, in top, cross-sectional view.

FIG. 7 depicts a handle 624 and post 722 of an example push-up exercise device, with an I-beam post 722, in a top, cross-sectional view. Here the post 722 is an I-beam post 722 defining a slot 740. The slot 740 may be along the vertical length of a wall of the post 722. The handle 724 may include a correspondingly I-shaped collar 726. The collar 726 may include an extension 742 considered to be received within the slot 740.

Similarly, the post may be a hollow beam (not shown) that defines a cavity. The hollow beam may include a slot providing access to the cavity from outside of a wall of the hollow beam. The collar (not shown) may include an extension configured to engage an inner surface of the cavity when the handle is tilted downward.

Figure 8:
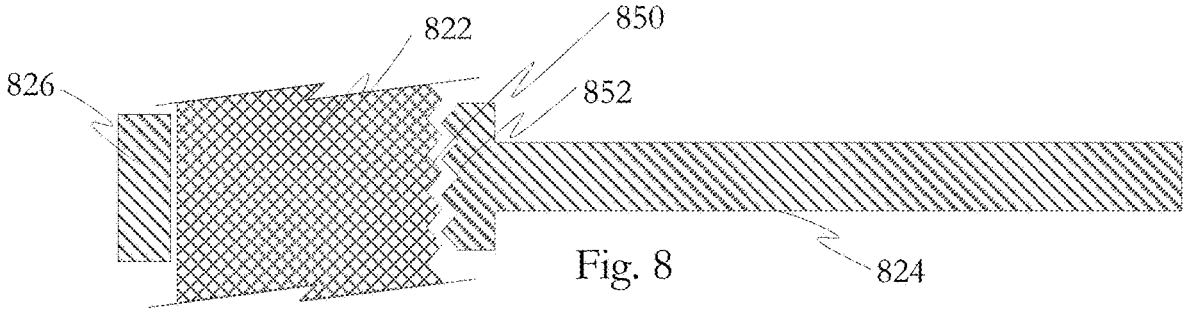
FIG. 8 depicts a handle and post of an example push-up exercise device, with a grooved engagement member, in lateral, cross-sectional view.

FIG. 8 depicts a handle 824 and post 822 of an example push-up exercise device, with grooved engagement members, in lateral, cross-sectional view. Here, an inside surface of the collar portion 826 may include an protrusion 850. An outside surface of the post 822 may include an engagement member 852, into which the protrusion 850 may be inserted. The protrusion 850 and/or the engagement member 852 may each include a series of groves and/or slots. The protrusion 850 and/or the engagement member 852 may each include an additional material or coating to increase friction. The protrusion 850 and/or the engagement member 852 may each include corresponding teeth. The protrusion 850 and/or the engagement member 852 may each include any structure suitable for increasing friction and preventing the handle 824 from slipping downward when the handle 824 is tilted to engage the collar 826 and the post 822.

Figure 9:
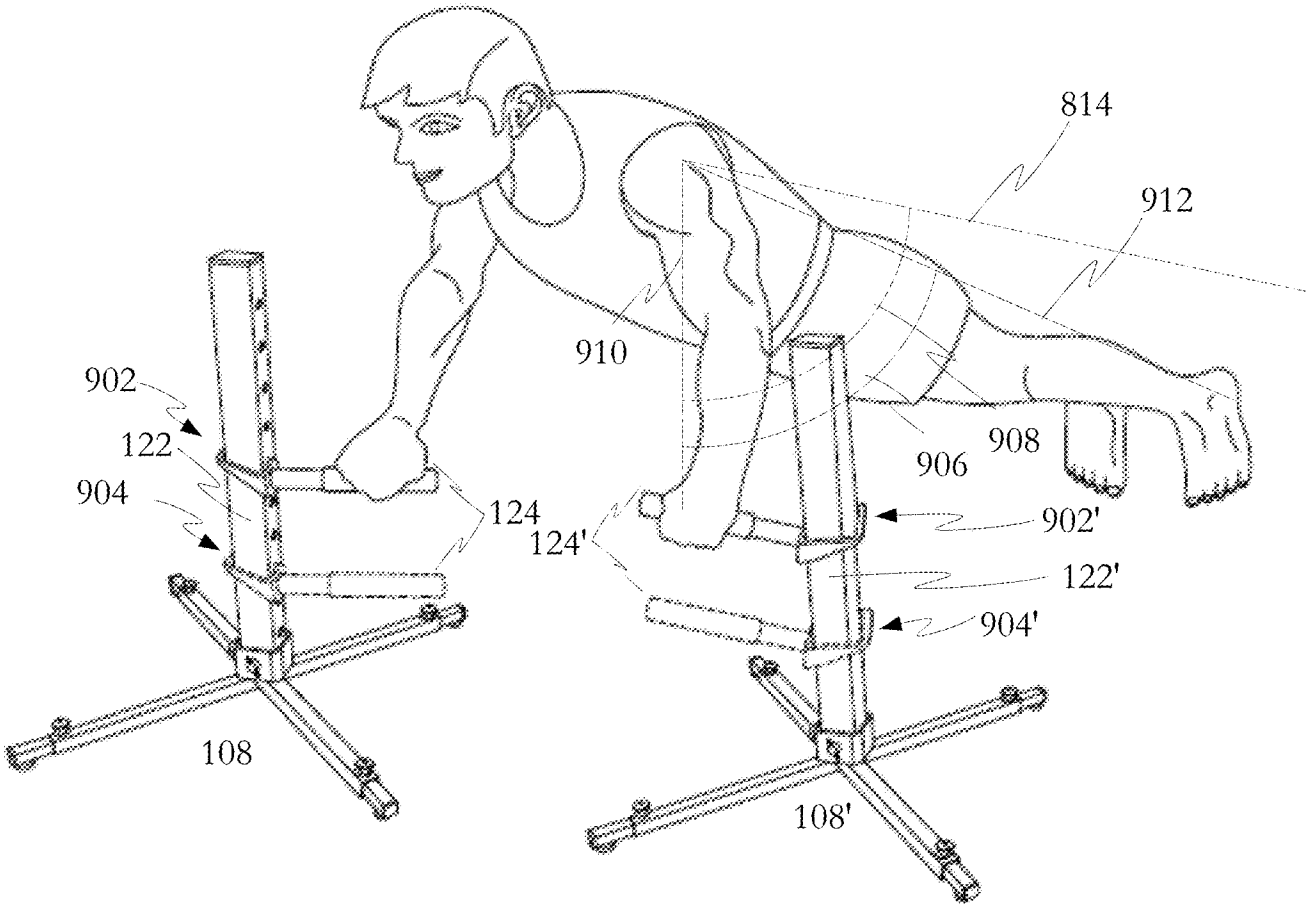
FIG. 9 illustrates the use of the push-up exercise device, demonstrating the continuous variability in body angle provided by the device.

FIG. 9 illustrates the use of an example push-up exercise device, demonstrating the continuous variability in body angle provided by the device. Here, a pair of push-ups exercise devices 108, 108' are shown in use. The devices have respective handles 124, 124'. As shown in solid line, the respective handles 124, 124' are in a relatively high position 902, 902'. In use, the handles 124, 124' may be continuously moved to any vertical position, including a relatively low position 904, 904', where the handles 124, 124' are shown in dotted line. The handles 124, 124' may be engaged at any position between the high position 902, 902' and the low position 904, 904'. When in the high position 902, 902' the push-up angle 906 between the arm plane 910 and the body plane 912 may be relatively small. When in the low position 904, 904', the push-up angle 908 between the arm plane 910 and the body plane 914 may be relatively large.

Because the push-up devices 108, 108' operate independently of one another, the handles 124, 124' need not be set at the same height. For example, the user may set one handle in an relatively high position and the other handle in a relatively low position. The ability to dial-in handle heights to very granular positions and the ability to set these heights independently of one another provides a significant level of variation in the the muscles that are impacted when performing push-ups. This variation may provide for greater push-up effectiveness.

Moreover, this variation may be dialed-in to specific push-up angles for each user. With a granular height setting and the ability to support both hands and feet, a large range of specific angles maybe be supported. For example, the posts 122, 122' may be graduated with marking to indicate height. Further those marking together with typical body dimensions may be used to set specific push-up angles.

Figure 10:
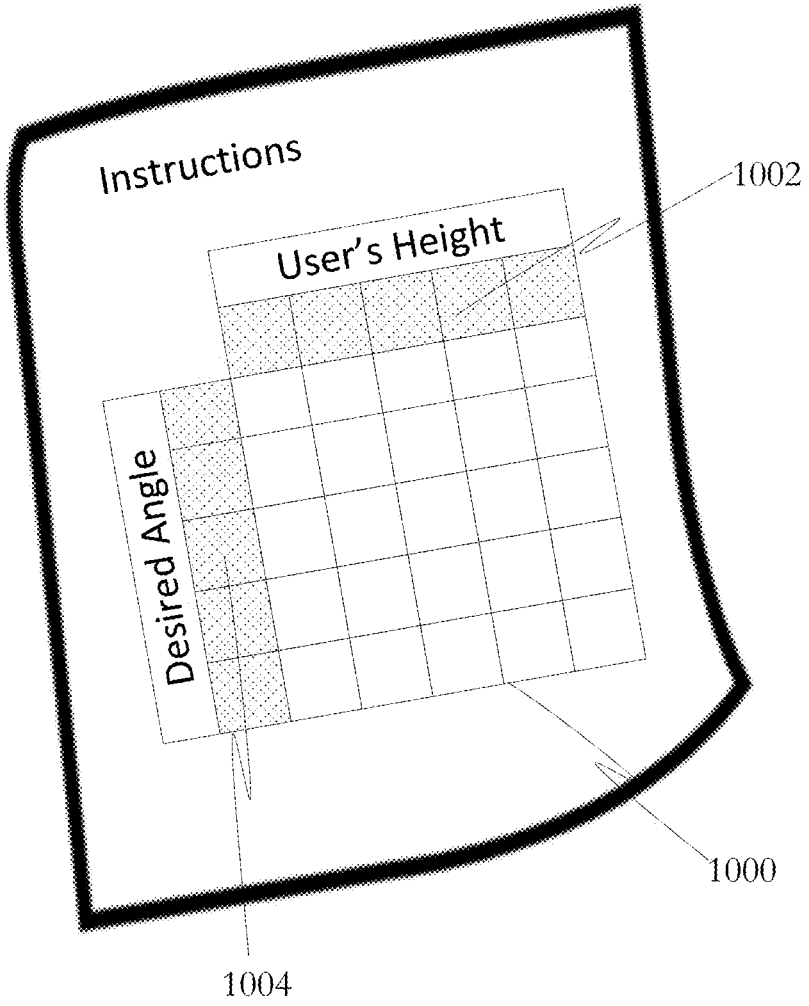
FIG. 10 illustrates an accompanying chart to map the user's height and desired push-up angle to specific setting on the push-up exercise device.

FIG. 10 illustrates an accompanying chart 1000 to translate the user's height and desired push-up angle to specific setting on the push-up exercise device. For a typical male user with a chest height of about 52 inches and an upper and lower arm length of about inches a push-up performed on the floor has a body angle of about 67 degrees. To dial-in an angle of 50 degrees, the push-up exercise device may be used to add an additional 13.5 inches to the height of the user's hands above the floor. Likewise, to simulate a 30-degree incline press, with an open body angle of 120 degrees, the push-up exercise device may be set at 46 inches under the user's feet.

Such calculations may be performed in bulk for a variety of average heights of men and women using common body proportion charts to find corresponding chest height and arm lengths. The results may be tabulated into an accompanying chart 1000, were the user's height is selected in a column 1002, and a desired angle is selected in a row 1004, and the corresponding intersection provides the push-up exercise device setting. Accordingly, a wide variety of push-up angles may be easily performed by users with the disclosed push-up exercise device. The device provides a level of granularity and variability not before seen. And these improvements demonstrate a significant technical achievement in the art.

The invention claimed is:

1. A push-up exercise device comprising:

a base configured to abut a surface;

a post extending from and fully supported by the base, the post configured for engagement at a plurality of locations along a vertical length of the post; and a handle that is slidably attached to the post, wherein the handle is configured to be moved to the plurality of locations along the vertical length of the post, and wherein the handle is configured to engage the post such that the handle can be secured in each of the plurality of locations by engagement of the handle with the post, and wherein the handle being slidably attached to the post enables the handle to be tilted up to disengage the handle from the post.

2. The push-up exercise device of claim 1, wherein the handle is configured to tilt downward with respect to the post due to a gravitational force, and wherein the handle is configured to be lifted upward toward a perpendicular with the post when moving the handle between the plurality of locations along the vertical length of the post.

3. The push-up exercise device of claim 1, wherein the handle comprises a grip portion connected to a collar, and wherein the collar defines an opening that is configured to receive the post therein, and wherein the collar is configured to translate along the post when the grip portion is tilted upward relative to the post.

4. The push-up exercise device of claim 3, wherein said collar comprises a wide portion proximate to the grip portion and a narrow portion opposite the wide portion.

5. The push-up exercise device of claim 4, wherein said collar further comprises a side portion connecting the wide portion and the narrow portion, wherein said side portion tapers from the wide portion's width to the narrow portion's width.

6. The push-up exercise device of claim 3, wherein the collar is configured to be misaligned with the post when the handle is tilted downward due to a gravitational force, and wherein the misalignment results in the engagement of the collar with the post.

7. The push-up exercise device of claim 3, wherein the handle is configured to remain secured in position with respect to the post when a user grips the grip portion and the user's body weight is applied to the handle.

8. The push-up exercise device of claim 3, wherein a top edge and a bottom edge of the collar are configured to engage the post when a user's body weight is applied to the handle such that the handle is in a locked position.

9. The push-up exercise device of claim 3, wherein the handle further comprises an engagement protrusion, wherein each of the plurality of locations comprises a void in the post configured to receive the engagement protrusion, and wherein the engagement protrusion is disposed to have a clear eye-line to a user performing a push-up with said user's hand on the grip portion of the handle.

10. The push-up exercise device of claim 3, wherein the handle further comprises an engagement protrusion, wherein each of the plurality of locations comprises a void in the post configured to receive the engagement protrusion, and wherein the engagement protrusion is disposed at an upper portion of the collar.

11. The push-up exercise device of claim 1, wherein the base comprises a plurality of legs, wherein each leg comprises a first portion that is fixed proximately to the post, a second portion that is extendable from the first portion distally, and an extension-engagement member configured to temporarily fix and unfix the first portion and the second portion, such that the overall width of the base is adjustable by the user without tools.

12. The push-up exercise device of claim 1, wherein the base defines an aperture configured to receive the post.

13. The push-up exercise device of claim 12, further comprising a fastener configured to secure the post to the base.

14. A push-up apparatus comprising:

a pair of push-up stands, wherein each of the pair of push-up stands comprises:

a base configured to abut a surface;

a post extending from the base; and a handle that is slidably attached to the post, wherein the handle is configured to be moved to a plurality of locations along a vertical length of the post and wherein the handle is configured to engage the post such that the handle can be secured in each of the plurality of locations by engagement of the handle with the post;

wherein the handles of the pair of push-up stands are configured to be moved to the plurality of locations independently such that the handles of the pair of push-up stands can be secured at different heights from the surface relative to each other, wherein each handle comprises a respective collar and a respective grip portion connected to the respective collar, wherein the collar defines an opening that is configured to receive the post therein, and wherein the collar is configured to translate along the post when the handle is tilted upward relative to the post.

15. The push-up apparatus of claim 14, wherein each handle is configured to remain secured in position with respect to the post when a user grips the handle and the user's body weight is applied thereto.

16. The push-up apparatus of claim 14, wherein said collar further comprises a side portion connecting the wide portion and the narrow portion, wherein said side portion tapers from the wide portion's width to the narrow portion's width.

17. The push-up apparatus of claim 14, wherein the handle further comprises an engagement protrusion, wherein each of the plurality of locations comprises a void in the post configured to receive the engagement protrusion, and wherein the engagement protrusion is disposed to have a clear eye-line to a user performing a push-up with said user's hand on the grip portion of the handle.

18. The push-up apparatus of claim 17, wherein the handle further comprises an engagement protrusion, wherein each of the plurality of locations comprises a void in the post configured to receive the engagement protrusion, and wherein the engagement protrusion is disposed at an upper portion of the collar.

* * * * *